US006785359B2

(12) United States Patent
Lemaitre

(10) Patent No.: US 6,785,359 B2
(45) Date of Patent: Aug. 31, 2004

(54) CATHODE FOR HIGH EMISSION X-RAY TUBE

(75) Inventor: Sergio Lemaitre, Whitefish Bay, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 9 days.

(21) Appl. No.: 10/064,606

(22) Filed: Jul. 30, 2002

(65) Prior Publication Data

US 2004/0022361 A1 Feb. 5, 2004

(51) Int. Cl.[7] ..... H01J 35/06
(52) U.S. Cl. ..... 378/136
(58) Field of Search ..... 378/136

(56) References Cited

U.S. PATENT DOCUMENTS 5,633,907 A 5/1997 Gravelle et al. ..... 378/121
5,637,953 A 6/1997 Wakalopulos ..... 313/421
5,907,595 A 5/1999 Sommerer ..... 378/136

*Primary Examiner*—Craig E. Church
(74) *Attorney, Agent, or Firm*—Cantor Colburn LLP

(57) ABSTRACT

A method and apparatus for an x-ray tube having an emitter and a differentially biased emitter-cup cathode configured to provide an electron beam of substantially greater perveance and beam compression ratio than otherwise obtainable with conventional cathode designs is disclosed. The method and apparatus include a cathode assembly opposing an anode and spaced apart therefrom. The cathode is maintained during operation of the x-ray tube at a negative potential with respect to the anode. The cathode assembly includes an emitter for emitting an electron beam to a focal spot on the anode during operation of the x-ray tube and a cathode front member having an aperture defined by the cathode front member on a first side of the emitter. A backing is disposed on a second side of the emitter and is operably connected to the cathode front member via a backing insulator. The cathode further includes a means for applying a differential bias in the cathode assembly to variably change the focal spot size.

27 Claims, 6 Drawing Sheets

CATHODE FOR HIGH EMISSION X-RAY TUBE

BACKGROUND OF INVENTION

The present invention relates generally to x-ray tubes and, more particularly, to a cathode configuration therefor.

Presently available medical x-ray tubes typically include a cathode assembly having an emitter and a cup. The cathode assembly is oriented to face an x-ray tube anode, or target, which is typically a planar metal or composite structure. The space between the cathode and anode is evacuated.

A disadvantage of typical cathode designs is that the emitter, which typically comprises a helically coiled tungsten wire filament, tends to be rather large and electrons are emitted radially outward from all surfaces of the filament surface. The cup, therefore, must be designed to produce a very tailored electric potential distribution in the vacuum such that all electron trajectories are redirected from their initial divergent motion toward a very small focal spot on the anode surface. This is commonly done by configuring a uniformly biased cathode cup having a carefully machined profile in close proximity to the filament(s) for passively shaping the electric field leading to the focal spot. For design purposes it is usually sufficient to treat the coiled filament as a solid emitting cylinder, and to neglect detail at the level of individual turns of the coil. It is also usually sufficient to be concerned only with the focal spot width, rather than its complete two-dimensional shape because the focal spot length can be more-or-less independently set by emitter-cup changes which do not strongly alter the width. However, even with this design freedom, it is difficult in practice to design a cup which produces such tailored electric fields and leads to a small focal spot width. The present state-of-the-art is represented by filament coils of major diameter around 1 millimeter which can be focused onto a 0.1 millimeter-wide focal spot on the anode, i.e., a beam compression ratio of 10.

Recent developments in medical imaging, however, require larger electron beam currents and better electron beam optics than can be obtained with the technology mentioned above. One way to arrive at higher electron beam current densities in the focal spot is to start with a larger thermionic emitter area combined with a subsequently higher electron beam compression ratio (defined by the ratio of the focal spot area divided by the emissive area of the filament). A universal limitation of electron emitters is that the net emission current as measured between the cathode and anode cannot be increased without bound simply by increasing the primary emission current of the emitter. As used herein, primary emission denotes electrons leaving the emitter surface and does not include any electrons which return to the surface. More precisely, the net emission current density at the emitter is limited.

Thermionic electron emission is limited to about $4A/cm^2$. The net emission current is the primary emission current less any electron current returning to the emitter surface. At very low primary emission current density, corresponding to low heating current and low emitter temperature for a thermionic emitter, the net emission current density will increase in nearly direct proportion to any increase in primary emission current density. Conversely, at very high primary emission current density, the electron density immediately in front of the emitter surface is so high that the self-charge of the electron cloud completely counteracts the electric field at the emitter surface caused by the cathode-anode potential difference. This latter condition is referred to as a saturated emitter; further increases in primary current density do not appreciably increase the net emission current. Between these two extremes is a smooth transition where increases in primary emission current density lead to less than proportionate increases in net emission current, and practical x-ray tubes often operate in this transition regime. All electron emitters are limited by this fundamental process, independent of the emitter material and emission mechanism.

A useful figure-of-merit for characterizing the overall capability of a cathode is its perveance, defined as the ratio $I/V^{3/2}$, where I is the net electron current and V is the potential difference between the cathode and anode. Additionally, the self-charge of the electrons in the vacuum can alter the electric potential and can cause undesirable changes such as enlargement of the focal spot size, sometimes referred to as blooming. Thus, cathode designs which are capable of meeting design goals on net current and yet which operate far below their inherent saturation current density can be advantageous. Finally, there is ordinarily a tradeoff between the useful life of a thermionic emitter and its operating temperature such that it can be desirable to operate the emitter at a lower temperature, and hence a lower primary emission current density.

A further disadvantage of typical cathode designs is that the cup design needed to properly focus the electrons results in a significant reduction in the saturation current of the cathode, and hence the maximum obtainable x-ray emission over that which would be expected if the filament were operated in free space apart from the cup. In particular, the aforementioned requirement that the initial, radially directed electron distribution from a helical coil filament be redirected onto the small focal spot leads one to place the filament emitter into a rather narrow slot. Unfortunately, this reduces the electric field normal to the front surface of the filament significantly below the average electric field present in the cathode-anode gap, which is on the order of V/L. Here, V is the electric potential between the cathode and anode, and L is the cathode-anode spacing. The electric field strength normal to the emitter surface, in the absence of any electron emission, determines the saturation current density of each point on the filament surface. Further, the electric field strength normal to the emitter surface is highest only on that portion of the filament which is closest to the anode; it decreases away from this one point; hence, the saturation current density decreases away from this one particular location. In principle, the emitting area may always be increased to obtain a higher total emission current, but as noted hereinabove, it is difficult to increase the filament size without also undesirably increasing the focal spot size.

A further limitation of conventional filament-cup cathode designs is that it is quite difficult in practice to form anything resembling a laminar electron beam wherein the trajectories of electrons emitted from various locations on the filament do not cross each other as they move from the cathode to the anode. As a result, the spatial distribution of current density across the width of the focal spot on the anode surface is not the gaussian distribution which would lead to the best modulation transfer function and hence the best image quality. Instead, the focal spot current distribution is typically double-peaked. The peak electron current density within the focal spot on the target is limited by the peak temperature capability of the anode. Therefore, to the extent that the actual peak current density exceeds that of an otherwise equivalent gaussian spatial distribution for a given anode design, the total current, and hence the maximum achievable x-ray fluence, will be reduced. It is not necessary that the electron flow be close to laminar in order to create the desirable gaussian spatial distribution of electron current, but the highly nonlaminar nature of the electron beam created by conventional filament-cup cathode designs makes the formation of a gaussian focal spot quite difficult in practice. Another limitation of conventional filament-cup cathode designs is that it is quite difficult in practice to change the focal spot size without the need to design a new cathode for different (e.g. large and small) focal spots.

An emitter-cup cathode which simultaneously provides higher emission current, smaller focal spot width, and better modulation transfer function has been heretofore unavailable. Accordingly, it is desirable to provide an emitter-cup x-ray tube cathode which overcomes the hereinabove described disadvantages. The importance of improved emission capabilities combined with the ability to focus higher beam currents into smaller and variably sized focal spots is clearly driven by the need to improve the image quality of the medical imaging system using current thermionic emission technology.

SUMMARY OF INVENTION

A method and apparatus for an x-ray tube having an emitter and a differentially biased emitter-cup cathode configured to provide an electron beam of substantially greater perveance and beam compression ratio than otherwise obtainable with conventional cathode designs is disclosed. In one embodiment, a method for operating an X-ray source includes emitting an electron beam along a beam path from a cathode; producing a dipole field with a differentially biased cathode and interacting the electron beam with the dipole field and the differential bias to focus and deflect the electron beam onto a focal spot on an anode to cause X-rays to be emitted from the anode. The dipole field is modified with a means for changing the differential bias to shape the electron beam on the anode to effect the focal spot size to produce a predetermined electron beam compression ratio.

In another embodiment, a cathode for x-ray tube is disclosed. The cathode includes a cathode assembly opposing an anode and spaced apart therefrom. The cathode is maintained during operation of the x-ray tube at a negative potential with respect to the anode. The cathode assembly includes an emitter for emitting an electron beam to a focal spot on the anode during operation of the x-ray tube and a cathode front member having an aperture defined by the cathode front member on a first side of the emitter. A backing is disposed on a second side of the emitter and is operably connected to the cathode front member via a backing insulator. The cathode assembly further includes a means for applying a differential bias in the cathode to variably change the focal spot size. The cathode backing is biased at Vbacking, the aperture of the cathode front member is independently biased at Vaperture and the emitter is biased at Vemitter, and Vback<Vemitter provides for a larger beam compression ratio than when Vback≧Vemitter.

DETAILED DESCRIPTION

Figure 1:
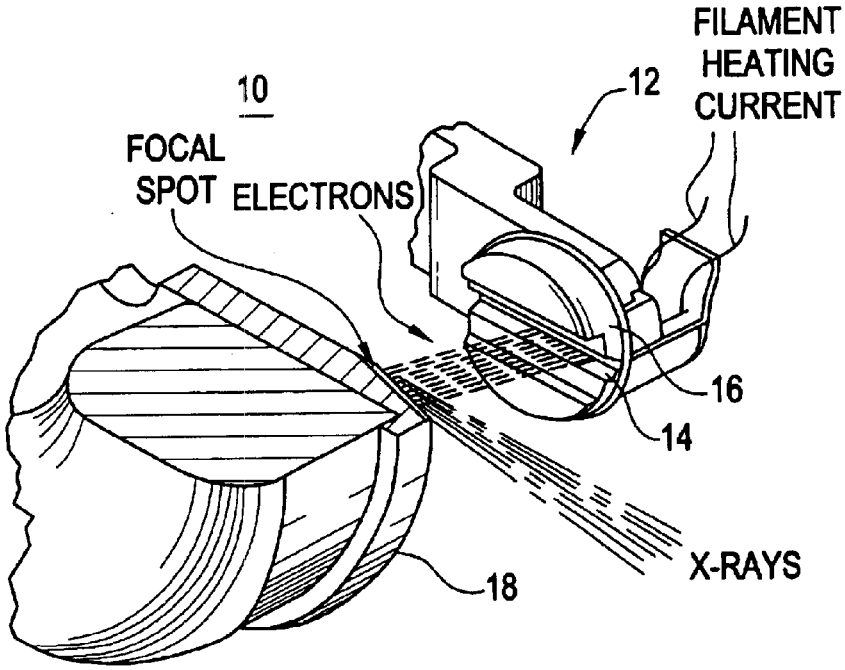
FIG. 1 PRIOR ART
FIG. 1 is a perspective view of a conventional x-ray tube cathode design.
Figure 2:
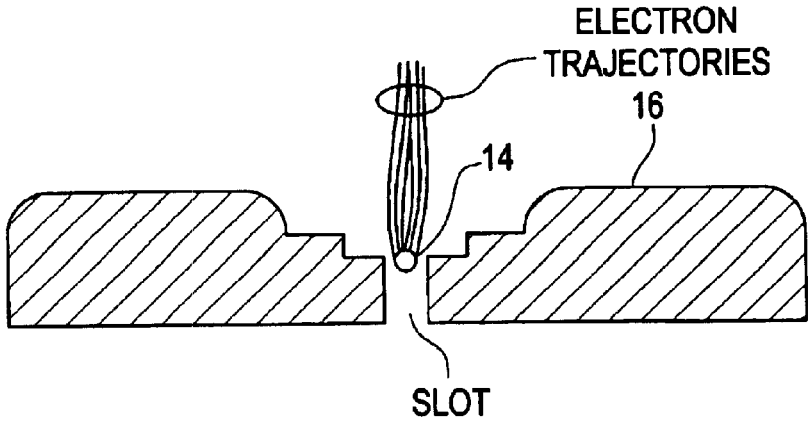
FIG. 2 PRIOR ART
FIG. 2 is a cross sectional view of the x-ray tube of FIG. 1.

FIGS. 1 and 2 illustrate a conventional x-ray tube 10 including a cathode 12 having an emitter 14 and a cup 16. Cathode 12 is oriented to face an x-ray tube anode 18, or target, which is typically a planar metal or composite structure. For many applications wherein high x-ray flux is required, the anode itself is a disk which is rotated at a high speed (typically 1000 to 10,000 revolutions per minute) in order to keep the peak anode temperature in the focal spot to an acceptable value. The cathode assembly is typically held from 20 to 200 kilovolts negative with respect to the anode. The space, or air gap, between the cathode and anode is evacuated to improve the voltage standoff capability of the gap and reduce scattering by electronatom collisions. Emitter 14 is typically a helically coiled tungsten wire filament which is heated by passing an electric current of several amperes through the wire to a temperature sufficient for thermionic emission of electrons. Emitter 14 is set into cup 16. The potential difference between the cathode and anode accelerates the thermionically emitted electrons to the desired kinetic energy, and guides them to a suitable line focus on the anode, where x-rays are then generated by bremsstrahlung and other processes which are characteristic of the anode material. The shape of the cup is chosen so as to form the desired electron beam cross section as it impacts the anode, i.e., the focal spot size and shape. The electric potential in the vacuum may be altered further through the application of an electric potential, or bias, between the emitter and the cup. Practical cathode assemblies are designed to produce the best compromise between total emission current, focal spot line width, and other measures of performance.

Figure 3:
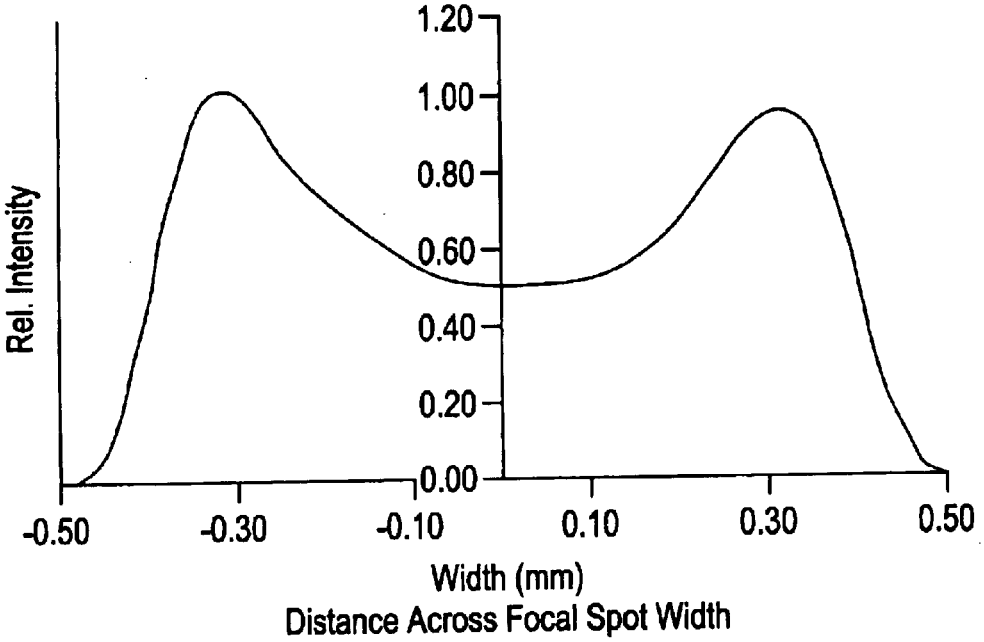
FIG. 3 graphically illustrates a focal spot profile showing the spatial distribution of electron current at the anode surface of a conventional x-ray tube such as that illustrated in FIGS. 1 and 2.

FIG. 3 graphically illustrates the double-peaked focal spot current distribution typical of conventional filament-cup designs such as that illustrated in FIG. 1. As explained hereinabove, this is the result of the highly nonlaminar nature of the electron beam created by such conventional filament-cup cathode designs which makes the formation of a gaussian focal spot current distribution quite difficult in practice.

Figure 4:
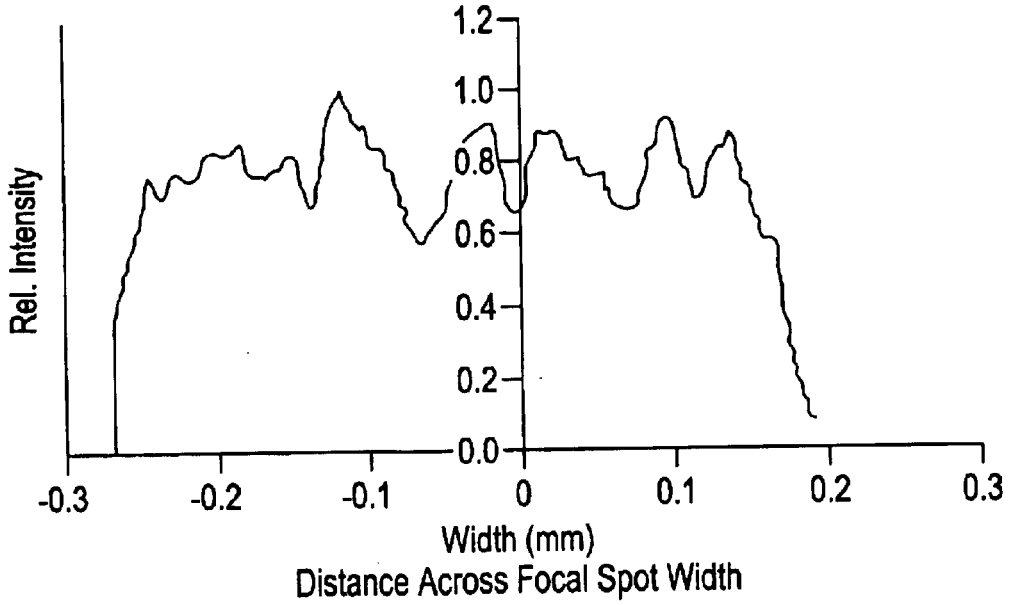
FIG. 4 graphically illustrates a computer simulated focal spot profile for an x-ray tube constructed according to a preferred embodiment of the present invention.

In accordance with exemplary embodiments of the present disclosure, an emitter-cup cathode configuration is provided which produces an approximately flat focal spot current distribution. FIG. 4 graphically illustrates such a desirable gaussian focal spot current distribution in a computer simulation using an exemplary embodiment of the present disclosure described below which would lead to a better modulation transfer function and hence the best image quality for x-ray imaging.

Figure 5:
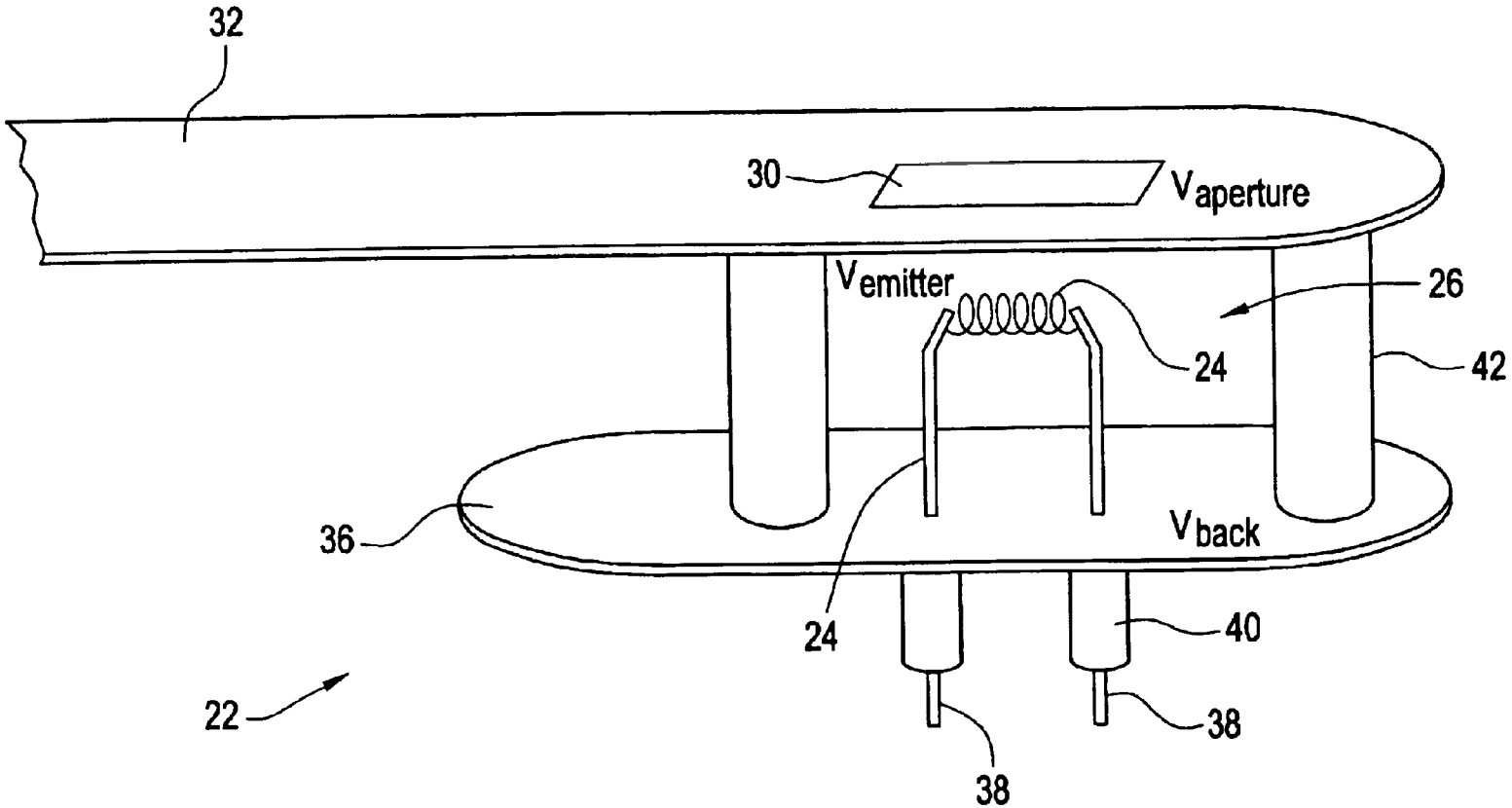
FIG. 5 is a schematic perspective view of an emitter-cup cathode according to a preferred embodiment of the present disclosure.
Figure 6:
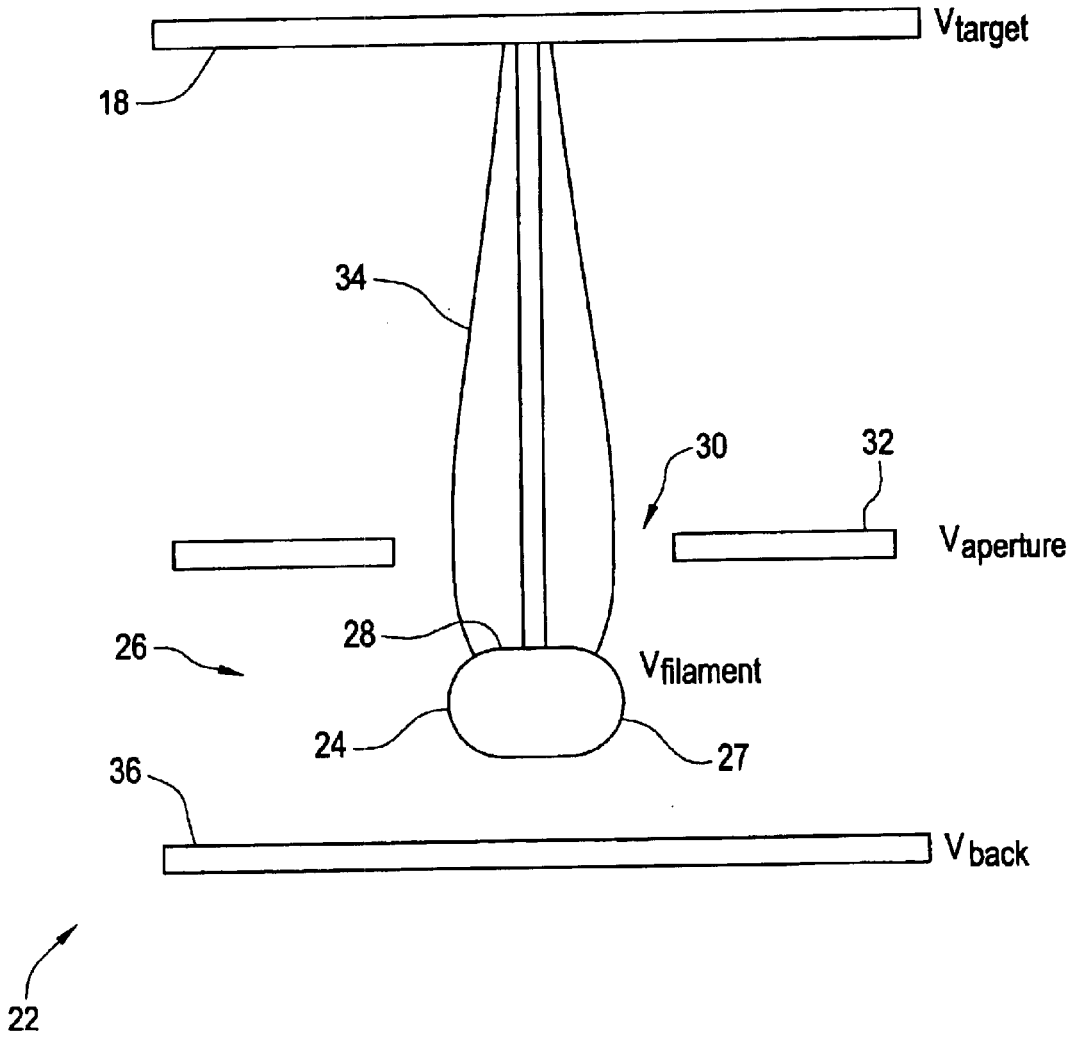
FIG. 6 is a cross sectional view of the emitter-cup cathode of FIG. 5.

FIGS. 5 and 6 illustrate an emitter-cup x-ray tube cathode 22 in accordance with an exemplary embodiment of the present disclosure. Cathode 22 comprises an emitter 24 set into a cavity 26. In accordance with a preferred embodiment of the present disclosure (see FIG. 6), emitter 24 is a coiled filament with at least one side of the filament having an approximately planar shape with an emitting area on the order of several square millimeters. "Approximately planar", as used herein, means a shape distinct from a coiled wire filament, but not necessarily flat. That is, the surface might have some curvature.

One advantage of an approximately planar emitter, as opposed to a conventional coiled filament, is that the electrons emitted from one face travel in roughly the same direction (normal to the face), whereas electrons emitted from a coil (or even a portion, e.g., one-half, of a coil) have little organized net collective motion. In both cases, however, the motion of the electrons is not entirely collective since there is a random component arising from the finite emitter temperature. With a coiled filament, shaping the electric potential so as to gather all the divergent electron trajectories into a small focal spot is quite difficult, whereas with an approximately flat emitter, the electron trajectories are already generally in the proper direction, and the electric potential need only perturb the trajectories to create the same focal spot.

Any suitable emitter material and mode of electron emission may be used with an emitter-cup cathode of the present disclosure. One example of a suitable emitter material is tungsten foil having a thickness in an exemplary range from one to several mils. Tungsten foil offers the advantages that it can be precisely shaped, patterned, and otherwise manipulated using suitable metal-forming techniques; and it can be heated resistively by passing electric current through the tungsten or by an indirect method so as to emit electrons by the thermionic mechanism.

In the embodiment of FIG. 6, emitter 24 is shown as a generalized block with curved sides 27 and a generally planar front surface 28. The emitter block is set into cavity 26. The emitter faces a target surface which is held at some positive electric potential ($V_{target}$) with respect to the emitter, typically 20–200 kilovolts for medical imaging applications, for example. Electrons produced by the emitter are accelerated by the potential difference and hit the anode 18, where both characteristic and braking x-radiation are produced.

In many conventional medical x-ray tubes, the anode is not an idealized point or line, or even the perforated anode of a practical electron gun; rather, it approximates a plane. For an approximately planar anode, the electric field lines are normal to the anode surface, instead of extending more-or-less radially outward from the desired focal spot, and the cathode will need to more strongly converge the electron trajectories than would be the case if the anode more closely approximated a point or line.

The embodiment of FIGS. 5 and 6 illustrates a cup configuration optimized for use in a line-focus, planar-anode x-ray tube. It comprises the following: emitter 24, an aperture 30 defined by a cathode front member 32. Aperture 30 in member 32 is at an electric potential ($V_{aperture}$) for completing formation of an electron beam 34 forming from emitter 24. Emitter 24 extends from a cathode backing 36 facing cathode front member 32 on the other side of emitter 24. Emitter 24 extends from cathode backing 36 via two electrodes 38 of emitter 24 having an insulator 40 around each to maintain emitter 24 at an electric potential ($V_{emitter}$) isolated from cathode backing 36 having an electric potential of ($V_{back}$). Cathode backing 36 is operably connected to cathode front member 32 while maintaining electrical isolation therebetween via a backing insulator 42. Although cathode backing 36 is shown having a planar surface, it will be understood by one skilled in the pertinent art that the backing may have another geometry. In addition, aperture 30 is not limited to a fixed slot and may include tabs (biased) that may be adjusted to limit the length profile of beam 34. The cathode assembly 22 is a differentially biased to produce a close approximation of the desirable laminar, homocentric, homogeneous electron beam.

Differential bias refers to independently biasing the cathode front member 36 at aperture 30 ($V_{aperture}$), backing 36 ($V_{back}$), and emitter 24 ($V_{emitter}$) having a filament ($V_{filament}$) of the cathode (FIG. 5) in an exemplary embodiment. In contrast to the passive shaping of the electric field in conventional cathodes, which is achieved by the geometrical shape of the cup around the filament(s), the independent biasing scheme allows active shaping of the electric field necessary to extract and accelerate electron beam 34. Therefore, independent biasing of the cathode cup components also allows continuous adjustment of the focal spot size over a range of focal spot sizes. For example, in vascular x-ray imaging tubes, this range could extend from 0.3 mm to 1.0 mm focal spots.

One exemplary method to arrive at higher electron beam current densities in the focal spot is to start thermionic electron emission from a larger thermionic emitter area combined with a subsequently higher electron beam compression ratio (defined by the ratio of the focal spot area divided by the emissive area of the filament). The problem of limited emission in conventional cathodes is optimized by including a straight section into the coiled filament.

Differential biasing ($V_{back}<V_{filament}$) offers improved beam optics that allows a larger beam compression ratio. This is in part due to the flat geometry of the largest part of the emissive area. Secondly this is achieved by reduction of electron emission from the curved parts of the filament through the presence of differentially negative potentials close to the filament surface (i.e., $V_{back}$). In an exemplary embodiment, this differentially negative voltage is less than about 10 kV while the beam potential is between about 80 to about 120 kV.

Further improvement of the beam optics may be achieved by optimizing the filament geometry, e.g. by replacing the straight section with a convex section. It is also contemplated to further improve the differentially biased cathode by the straight filament as viewed in length direction with a convexly shaped filament in length directions. This would allow an even higher compression ratio. Compared to a conventional cathode, the coil diameter in an exemplary embodiment is larger using a variable differentially biased cathode by actively shaping the electron beam formation using independent biasing the front ($V_{aperture}$) and the back ($V_{back}$) of the cathode assembly near the filament emitter 24. As a consequence, the wire diameter of the filament can be increased. It will be recognized by one skilled in the pertinent art that a larger wire diameter increases filament life if the filament is operated at the same relative temperature.

Figure 7:
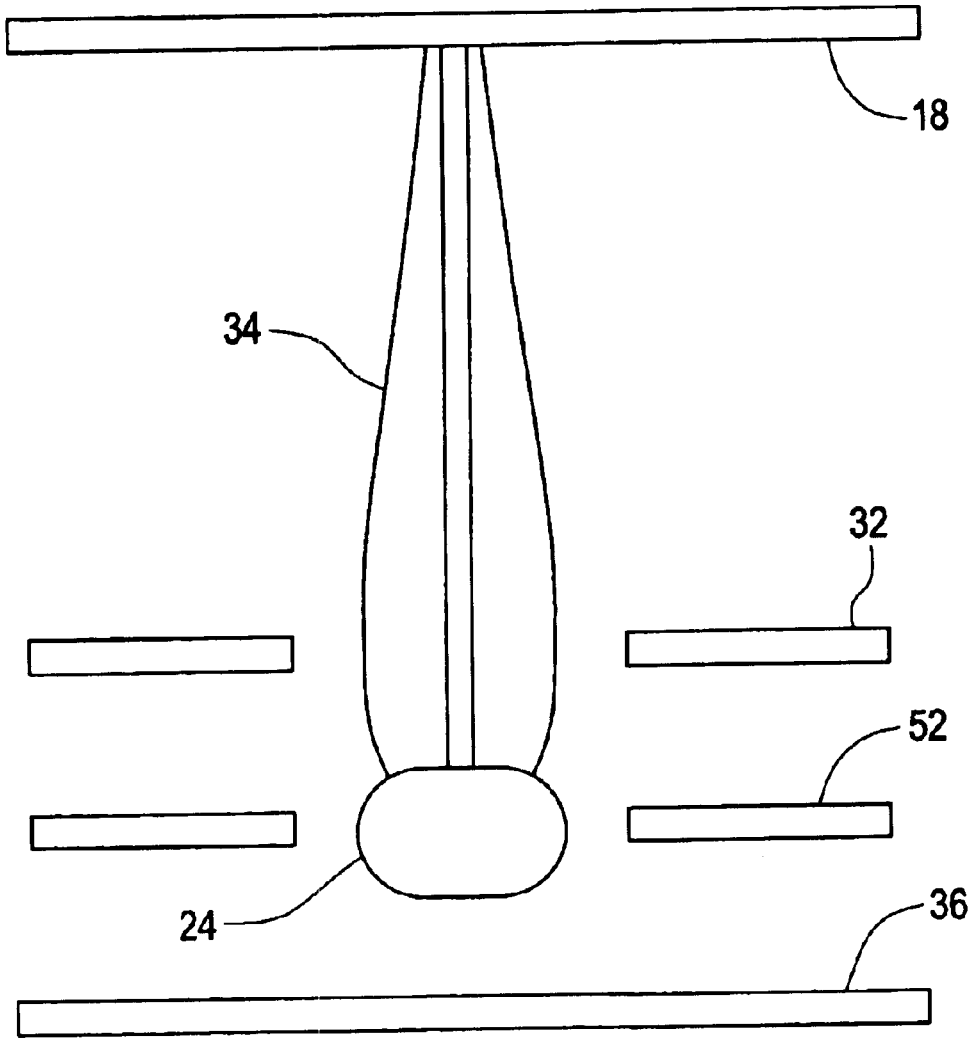
FIG. 7 is a cross sectional view of an alternative exemplary embodiment of the emitter-cup cathode of FIG. 6.

By way of illustration and referring to FIG. 7, the various portions of the emitter-cup can be viewed as performing independent manipulations of the electron trajectories. The planar shape of emitting surface 28 ensures that the initial electron motion is toward the focal spot, i.e., to the extent that can be achieved with the initial thermal distribution of electron velocities. $V_{back}$ at cathode backing 36 shapes the electric potential along the edges of the electron beam. $V_{aperture}$ at aperture 30 is used to perform the final beam manipulation on the medium-energy electron beam. Beyond the aperture, the electron momentum is sufficiently high that further guidance is neither necessary nor particularly productive, and the electrons are accelerated by the remaining cathode-anode potential difference until they reach the focal spot.

Advantageously, the embodiment of FIGS. 5 and 6 results in a small focal spot width for an emitter having a given width, or more generally, a given surface area, thus resulting in a high beam compression ratio without sacrificing emission current. In the prior art, the cathode cup is negatively biased relative to filament and therefore reduces perveance. An exemplary differentially biased cathode disclosed herein does not change perveance to first order, i.e. Vaperture and Vback remain approximately constant while focusing is done by changing Vback.

Referring now to FIG. 7, an alternative exemplary embodiment is illustrated having a second electrode 52 inserted between aperture 32 and backing 36 electrodes. It is contemplated that multiple electrodes/apertures may be inserted between the front electrode (i.e., aperture 32) and the backing 36 to increase flexibility for shaping the electric field. For example, two or more apertures may be inserted between front and back electrodes 32, 36. For the sake of manufacturing, however, it is desirable to limit the electrodes to a minimum (i.e. two electrodes, aperture 32 and backing 36).

Figure 8:
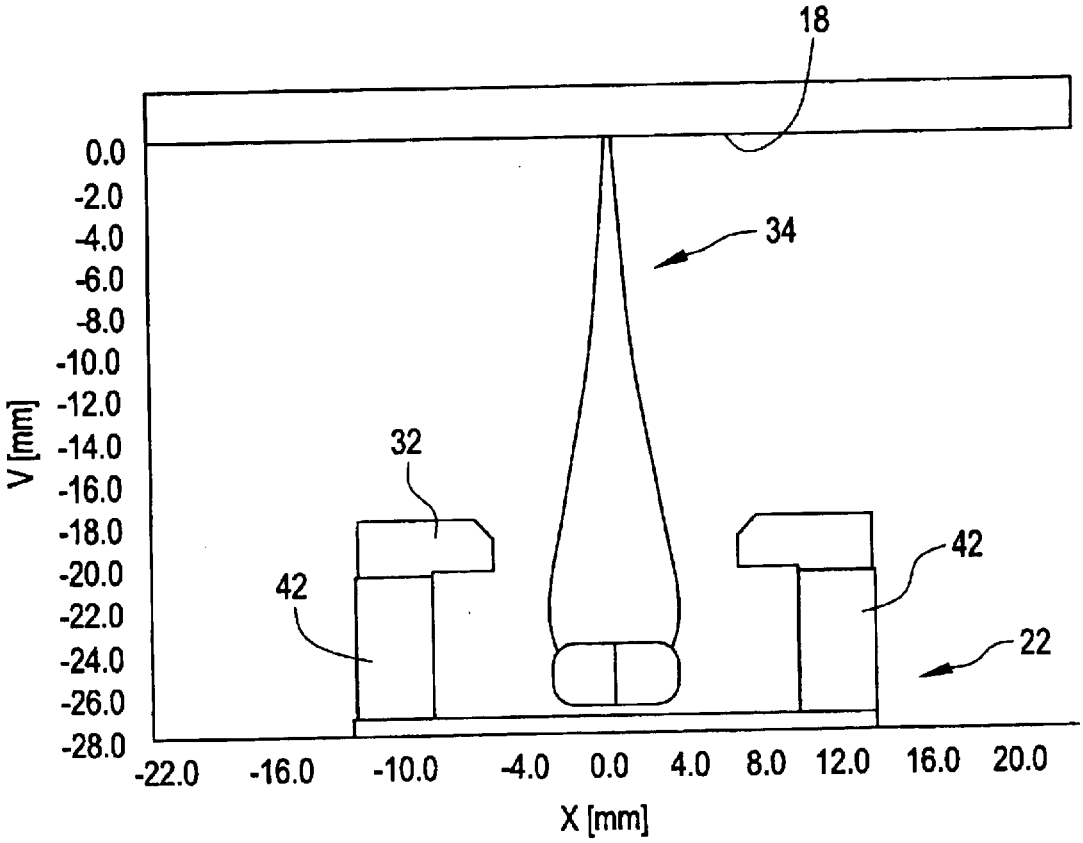
FIG. 8 graphically illustrates an electron beam spatial profile obtained from a computer simulation of an emitter-cup cathode such as those of FIGS. 5 and 6.

FIG. 8 illustrates electron beam 34 formation and electron beam profile obtained from an emitter-cup cathode such as that of FIGS. 5 and 6. FIG. 8 is a computer simulation for a differentially biased cathode displayed in cross section at the center of cathode assembly 22. The focusing of the beam width is shown. In the length direction the filament is assumed to be straight for the purpose of the simulation. The electron beam is focused into a 0.5 mm focal spot. The simulation starts with a geometric definition of the cathode-anode geometry which can be approximated as a two-dimensional cross section like that shown in FIG. 6 to simulate a line focus for the physical reasons described hereinabove. (Alternatively, cylindrical symmetry can be assumed in order to simulate a design intended to produce a point focus.) The cathode and anode surfaces are assumed to be perfect conductors at specified electric potentials. More specifically, $V_{back}$ is (−4.2 kV), $V_{filament}$ is (O V), and $V_{front}$ (i.e., $V_{aperture}$) is (0 V), and $V_{target}$ is (80 kV). The intervening space is discretized, and the electric potential in this region is determined by a second-order finite element method. Pseudoelectrons, each representing a large number of real electrons, are launched from each elemental area of the emitting surface with a distribution of initial direction and energy so as to mimic the thermal distribution of emitted electrons. The pseudoelectron trajectories are integrated until they intersect a metal surface, usually the anode. An iterative procedure follows, where the electron self-charge in each element of the discretized mesh is determined from knowledge of the pseudoelectron trajectories; then electric potential is recalculated. This iteration continues until a preset convergence criterion is reached. Once converged, the spatial distribution of the electron current at the focal spot can be reconstructed from the pseudoelectron trajectories. This simulation procedure has the usual practical advantages over actual fabrication of design test vehicles, and it is quantitatively accurate both because all important physical properties are known, and because the solution of the electric potential and pseudoelectron trajectories can be made arbitrarily accurate by well-known procedures.

A cathode according to the present invention may be advantageously refined further to meet requirements of image protocols which demand more than one net current and focal spot size. Still further, such a cathode may be designed to produce a relatively small focal spot width for low beam currents and to produce a larger focal spot for higher tube currents, thereby managing the peak thermal stress on the target.

Several additional advantages of the differentially biased emitter-cup cathode configuration of the present disclosure have been identified as follows. The anode itself need not be solid, but can be perforated to allow the electron beam to be further manipulated and utilized. Higher net current is possible because the emitting area, saturation current, and perveance of this new emitter-cup cathode configuration are all significantly higher than can be achieved with conventional designs. The small-spot mode is possible from the same large emitter because, compared with conventional designs, this invention can achieve significantly higher beam compression ratios. A significant advantage of using one emitter rather than two, beyond the reduction in mechanical complexity, is that the focal spots produced in the two operating modes are centered at the same physical location on the anode; that is, the focal spots are coincident. Good coincidence is required for certain medical imaging protocols, and a single emitter design avoids the potential for misalignment in a two-filament cathode design. A further operational advantage can be achieved by this design because, in practice, the focal spot size in the high-brightness mode is usually larger than the focal spot size in the low brightness mode in order to accommodate the thermal limitations of the anode surface This variable focal spot size can be achieved straightforwardly in the present disclosure by allowing focal spot blooming to occur in a controllable manner by altering the independent biases in the cathode assembly. More than 2–3 times the emission of prior art coiled filament cathodes is possible with a differentially biased cathode assembly. Furthermore, image quality tradeoff optimization is possible through infinitely adjustable focal spot size. In addition, there is no additional cathode features needed for gridding. Gridding is accomplished with $V_{filament}>V_{aperture}$, i.e., when biasing is reversed. The present disclosure also allows more robust filaments (larger wire diameter), and thus extended filament life. All well known technology is used with less electrical connections needed for a differentially biased cathode than with a conventional cathode tube. The present disclosure offers a simple mechanical design with less precision needed than prior art cathodes for filament set height and centering and provides a lower cost cathode compared to prior art cathodes used in vascular, angio, and CT applications.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method far operating an X-ray source comprising:

emitting an electron beam along abeam path from an emitter of a cathode;

producing a first dipole field between a backing and an aperture defined by said cathode within said electron beam with a differentially biased cathode and immersing said first dipole field and said differential bias within said electron beam to focus and deflect said electron beam onto a focal spot on an anode to cause X-rays to be emitted from said anode; and modifying said dipole field with a means for changing the differential bias to shape said electron beam on said anode to effect the focal spot size to produce a predetermined electron beam compression ratio.

2. The method as claimed in claim 1 comprising selecting said predetermined electron beam compression ratio from among a plurality of settable ratios.

3. The method as claimed in claim 1 wherein said modifying said first dipole field with a means for changing the differential bias comprises modifying said first dipole field with an independent bias applied to the components of the cathode.

4. The method as claimed in claim 3 wherein said components of the cathode include said backing with a bias of Vbacking, said emitter with a bias of Vemitter, and said aperture defined by a cathode front member with a bias of Vaperture.

5. The method as claimed in claim 4 further comprising Vbacking<Vemitter providing larger beam compression ratio than when Vbacking≧Vemitter.

6. The method as claimed in claim 5 further comprising Vemitter<Vaperture providing a reverse bias.

7. The method as claimed in claim 3 wherein a differential voltage between Vbacking and Vaperture is less than about 10 kV.

8. The method as claimed in claim 7 wherein a second dipole field between said cathode and anode has a beam potential of about 30 kV to about 16 kV.

9. The method as claimed in claim 1 further comprising increasing an emissive area of said emitter to increase the electron emission relative to an emitter having a circular cross section.

10. The method as claimed in claim 9 wherein said increasing emissive area includes at least one of a coiled filament having a substantially planar cross section portion, increasing length defining said coiled filament and increasing a diameter defining said coiled filament.

11. The method as claimed in claim 1, wherein said focal spot area includes a diameter in the range of about 0.1 mm to about 2 mm.

12. A method to focus high beam currents of electron emission in a cathode assembly opposing an anode and spaced apart therefrom into different sized focal spots in an x-ray tube, the method comprising:

biasing components of the cathode assembly independently, wherein the components include;

an emitter situated therein for emitting an electron beam to a focal spot on the anode during operation of the x-ray tube, a cathode front member having an aperture defined by the cathode front member on a first side of the emitter, and a backing disposed on an opposite second side of the emitter and connected to the cathode front member via a backing insulator, wherein the cathode front member and backing are independently biased producing a first dipole field between said backing and said aperture defined by said cathode front member immersing said emitter in said first dipole field within said electron beam to shape and accelerate the electron beam and guide the electron beam to the focal spot on the anode.

13. The method as claimed in claim 12, further comprising said cathode backing havings a bias of Vbacking, said aperture of said cathode front member having a bias of Vaperture and said emitter having a bias of Vemitter, wherein Vback<Vemitter providing a larger beam compression ratio than when Vback≧Vemitter.

14. The method as claimed in claim 13, further comprising Vemitter<Vaperture providing a reverse biasing.

15. An x-ray tube cathode comprising:

a cathode assembly opposing an anode and spaced apart therefrom, the cathode being maintained during operation of the x-ray tube at a negative potential with respect to the anode, the cathode assembly comprising;

an emitter situated therein for emitting an electron beam to a focal spot on the anode during operation of the x-ray tube, a cathode front member having an aperture defined by the cathode front member on a first side of the emitter, a backing disposed on an opposite second side of the emitter operably depending form the cathode front member via a backing insulator, wherein the aperture of the cathode front member and backing are independently biased producing a first dipole field between said backing and said aperture defined by said cathode front member immersing said emitter in said first dipole field within said electron beam to shape and accelerate the electron beam and guide the electron beam to the focal spot on the anode.

16. The x-ray tube as claimed in claim 15, wherein a portion of the emitter is defined with an approximately planar emitting surface.

17. The x-ray tube as claimed in claim 16, wherein the emitter is a coiled filament.

18. The x-ray tube as claimed in claim 16, wherein the emitter is one of a ribbon emitter, a dispenser cathode, an c-beam heated emitter and a field emitter.

19. The x-ray tube as claimed in claim 15 further comprising at least one intermediary electrode member having an aperture defined by the at least one intermediary electrode member, the at least one electrode member disposed between said cathode front member and said backing, the at least one electrode member configured to flexibly shape the electron beam emitted from the emitter.

20. The x-ray tube as claimed in claim 15 wherein a potential difference between said backing and said aperture includes Vbacking<Vaperture providing a larger beam compression ratio relative to when Vbacking≧Vaperture.

21. The x-ray tube as claimed in claim 15 wherein said independent bias includes Vemitter<Vaperture providing a reverse bias.

22. A cathode for x-ray tube comprising:

a cathode assembly opposing an anode and spaced apart therefrom, the cathode being maintained during operation of the x-ray tube at a negative potential with respect to the anode, the cathode assembly comprising;

an emitter situated therein for emitting an electron beam to a focal spot on the anode during operation of the x-ray tube, a cathode front member having an aperture defined by the cathode front member on a first side of the emitter, a banking disposed on a second side of the emitter and operably connected to the cathode front member via a backing insulator, and a means for applying a differential bias in the cathode producing a first dipole field between said backing and said aperture defined by said cathode front member immersing said emitter in said first dipole field within said electron beam to variably change the focal spot size.

23. The cathode as claimed in claim 22 further comprising at least one intermediary electrode member having an aperture defined by the at least one intermediary electrode member, the at least one electrode member disposed between said cathode front member and said backing, the at least one electrode member configured to flexibly shape the electron beam emitted from the emitter.

24. The cathode as claimed in claim 22 wherein the means include having the cathode front member, and backing being independently biased to shape and accelerate the electron beam and guide the electron beam to the focal spot on the anode.

25. The cathode as claimed in claim 24 wherein said cathode backing is biased at Vbacking, said aperture of said cathode front member is biased at Vaperture and said emitter is biased at Vemitter, and Vback<Vemitter providing for a larger beam compression ratio than when Vback≧Vemitter.

26. The cathode as claimed in claim 25 wherein Vemitter<Vaperture providing a reverse bias.

27. The cathode as claimed in claim 22 wherein said emitter is configured to increase electron emission therefrom relative to an emitter having a circular cross section by increasing an emissive area of said coiled filament including at least one of a flattening a portion defining a cross section of said coiled filament lengthening said coiled filament and increasing a diameter of said coiled filament.

* * * * *

UNITED STATES PATENT AND TRADEMARK OFFICE

CERTIFICATE OF CORRECTION

PATENT NO. : 6,785,359 B2
APPLICATION NO. : 10/064606
DATED : August 31, 2004
INVENTOR(S) : Sergio Lemaitre It is certified that error appears in the above-identified patent and that said Letters Patent is hereby corrected as shown below:

Column 4,
Line 25, after "by", delete "electronatom" and insert therefor --electron-atom--.

Column 8,
Line 58, after "method", delete "far" and insert therefor --for--.
Line 59, after "along" delete "abeam" and insert therefor --a beam--.

Column 9,
Line 30, after "increase", delete "the".
Line 45, after "increasing", insert therefor --an--.
Line 36, after "increasing", insert therefor --a--.
Line 63, after "backing", delete "havings" and insert therefor --having--.

Column 10,
Line 2, before "providing" delete "Vemiter < Vaperture" and insert therefor --Vemitter > Vaperture--.
Line 31, before "heated" delete "c-beam" and insert therefor --e-beam--.
Line 44, after "includes" delete "Vemitter <Vaperture" and insert therefor --Vemitter > Vaperture--.

Signed and Sealed this

First Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,785,359 B2
APPLICATION NO. : 10/064606
DATED : August 31, 2004
INVENTOR(S) : Sergio Lemaitre It is certified that error appears in the above-identified patent and that said Letters Patent is hereby corrected as shown below:

Title Page,

Item (56) References Cited, U.S. Patent Documents, insert --

| | | | |
|---|---|---|---|
| 5,031,200 | 7/1991 | Plessis et al. | 378/136 |
| 5,910,974 | 6/1999 | Kuhn et al. | 378/138 |
| 6,115,453 | 9/2000 | Hell et al. | 378/136 |
| 6,556,656 | 4/2003 | Hess et al. | 378/136 |
| 5,060,254 | 10/1991 | de Fraguier et al. | 378/136 -- |

Signed and Sealed this

Fourteenth Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 6,785,359 B2
APPLICATION NO. : 10/064606
DATED : August 31, 2004
INVENTOR(S) : Sergio Lemaitre It is certified that error appears in the above-identified patent and that said Letters Patent is hereby corrected as shown below:

Column 4,
Line 25, after "by", delete "electronatom" and insert therefor --electron-atom--.

Column 8,
Line 58, after "method", delete "far" and insert therefor --for--.
Line 59, after "along" delete "abeam" and insert therefor --a beam--.

Column 9,
Line 30, after "increase", delete "the".
Line 45, after "increasing", insert therefor --an--.
Line 36, after "increasing", insert therefor --a--.
Line 63, after "backing", delete "havings" and insert therefor --having--.

Column 10,
Line 2, before "providing" delete "Vemitter < Vaperture" and insert therefor --Vemitter > Vaperture--.
Line 31, before "heated" delete "c-beam" and insert therefor --e-beam--.
Line 44, after "includes" delete "Vemitter <Vaperture" and insert therefor --Vemitter > Vaperture--.

This certificate supersedes Certificate of Correction issued August 1, 2006.

Signed and Sealed this

Thirteenth Day of March, 2007

JON W. DUDAS
*Director of the United States Patent and Trademark Office*